US009027531B2

(12) United States Patent
Peters et al.

(10) Patent No.: US 9,027,531 B2
(45) **Date of Patent: *May 12, 2015**

(54) IGNITION ENERGY CONTROL FOR MIXED FUEL ENGINE

(71) Applicant: Ford Global Technologies, LLC, Dearborn, MI (US)

(72) Inventors: Mark William Peters, Wolverine Lake, MI (US); Jason Eugene Devries, Belleville, MI (US); John M. Roth, Grosse Ile, MI (US); John Hedges, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/078,417

(22) Filed: Nov. 12, 2013

(65) Prior Publication Data

US 2014/0163846 A1 Jun. 12, 2014

Related U.S. Application Data

(63) Continuation of application No. 11/936,336, filed on Nov. 7, 2007, now Pat. No. 8,584,650.

(51) Int. Cl.

| | |
|---|---|
| ***F02P 5/145*** | (2006.01) |
| ***F02D 41/06*** | (2006.01) |
| ***F02D 35/02*** | (2006.01) |

(Continued)

(52) U.S. Cl.

CPC ..... *F02D 41/064* (2013.01); *F02D 35/025* (2013.01); *F02D 37/02* (2013.01); *F02D 41/0025* (2013.01); *F02D 2200/503* (2013.01); *F02P 3/00* (2013.01); *F02P 5/045* (2013.01); *F02P 9/002* (2013.01); *F02P 15/08* (2013.01)

(58) Field of Classification Search

USPC ..... 123/1 A, 27 GE, 295, 298–300, 304, 123/305, 406.11, 406.13, 406.19, 406.3, 123/406.31, 406.35, 406.47, 406.55, 431, 123/435, 478, 480, 491, 575, 594–596, 620, 123/636–638; 701/103–105, 113

See application file for complete search history.

(56) References Cited

U.S. PATENT DOCUMENTS

| | | | |
|---|---|---|---|
| 3,147,091 | A | 9/1964 | Toulmin |
| 3,153,901 | A | 10/1964 | Rifkin |

(Continued)

FOREIGN PATENT DOCUMENTS

| | | | |
|---|---|---|---|
| CN | 1534179 | A | 10/2004 |
| JP | 2007187106 | A | 7/2007 |

OTHER PUBLICATIONS

Partial Translation of Office Action of Chinese Application No. 200810175340.2 Issued Jun. 27, 2012, State Intellectual Property Office of PRC, 2 Pages.

*Primary Examiner* — John Kwon
*Assistant Examiner* — Johnny H Hoang
(74) *Attorney, Agent, or Firm* — Julia Voutyras; Alleman Hall McCoy Russell & Tuttle LLP

(57) ABSTRACT

A method of operating an engine including varying a level of ignition energy provided to the engine during an engine start is provided. For example, the ignition energy level may be varied responsive to the amount of alcohol in fuel delivered to the engine in order to improve cold engine starting with higher alcohol fuels.

13 Claims, 8 Drawing Sheets

(51) Int. Cl.

| | |
|---|---|
| ***F02P 5/04*** | (2006.01) |
| ***F02P 9/00*** | (2006.01) |
| *F02D 37/02* | (2006.01) |
| *F02D 41/00* | (2006.01) |
| *F02P 3/00* | (2006.01) |
| *F02P 15/08* | (2006.01) |

(56) References Cited

U.S. PATENT DOCUMENTS

| | | | |
|---|---|---|---|
| 3,526,124 | A | 9/1970 | Wostl |
| 4,023,539 | A | 5/1977 | Noguchi et al. |
| 4,974,552 | A | 12/1990 | Sickafus |
| 5,146,882 | A | 9/1992 | Brinkman et al. |
| 5,186,146 | A | 2/1993 | Sohma et al. |
| 5,284,438 | A | 2/1994 | McGill et al. |
| 5,381,767 | A | 1/1995 | Kikuchi |
| 5,467,755 | A | 11/1995 | Konrad et al. |
| 5,476,084 | A | 12/1995 | Morganti et al. |
| 5,553,594 | A | 9/1996 | Ehlers et al. |
| 5,762,052 | A | 6/1998 | Minkov et al. |
| 6,155,241 | A | 12/2000 | Hohner et al. |
| 6,530,361 | B1 | 3/2003 | Shiraishi et al. |
| 6,575,150 | B2 | 6/2003 | Katoh et al. |
| 6,584,955 | B1 | 7/2003 | Ketterer et al. |
| 6,601,560 | B1 | 8/2003 | Serve |
| 6,609,493 | B2 | 8/2003 | Yamaguchi et al. |
| 6,975,933 | B2 | 12/2005 | Abe et al. |
| 7,101,513 | B2 | 9/2006 | Naka et al. |
| 7,464,688 | B2 | 12/2008 | Yu et al. |
| 7,526,374 | B2 | 4/2009 | Carr et al. |
| 2004/0168671 | A1 | 9/2004 | Yamaguchi et al. |
| 2006/0236976 | A1 | 10/2006 | Carlson |
| 2008/0046163 | A1 | 2/2008 | Kagleder |
| 2009/0024296 | A1 | 1/2009 | Wiggins et al. |

IGNITION ENERGY CONTROL FOR MIXED FUEL ENGINE

CROSS REFERENCE TO RELATED APPLICATIONS

The present application is a continuation of U.S. patent application Ser. No. 11/936,336, entitled "IGNITION ENERGY CONTROL FOR MIXED FUEL ENGINE," filed on Nov. 7, 2007, the entire contents of which are hereby incorporated by reference for all purposes.

SUMMARY AND BACKGROUND

Some engines may be configured to utilize a fuel that includes a mixture or blend of different fuel components. As one example, some engines can utilize E85 which includes a mixture of approximately 85% ethanol and 15% gasoline. Still other engines may be configured as a flex-fuel engine, whereby a plurality of different fuel mixtures may be used by the engine. For example, a flex-fuel engine may be configured to utilize a variety of different blends of ethanol and gasoline including up to 100% gasoline, E10 which includes approximately 10% ethanol and 90% gasoline, E85, and up to 100% ethanol. Thus, engines can utilize a variety of different fuel mixtures. Alternatively, other biofuels such as methanol may be used.

The inventors herein have recognized that the use of fuel mixtures that include ethanol or other biofuels such as methanol can result in reduced combustion quality during lower temperature conditions. The inventors have noted that ethanol has a higher temperature of vaporization than gasoline. Thus, the rate of vaporization of the mixed fuel is reduced as the relative concentration of ethanol in the fuel increases. During a start-up of the engine, such as from ambient temperature conditions which may be referred to as a cold start, the reduced vaporization of the mixed fuel due to increased ethanol concentrations may be insufficiently combusted and may result in engine misfire or stall. Thus, under these conditions, one approach has been to increase the total amount of fuel delivered to the engine in order to ensure that sufficient combustion of the fuel occurred. However, the use of additional fuel as a remedy to the reduced vaporization of the mixed fuel can result in increased levels of unburned fuel and products of combustion that are exhausted by the engine.

To address at least some of the above issues, the inventors have provided, as one example, an engine system for a vehicle, including an internal combustion engine having at least one cylinder; a fuel system configured to provide a fuel to the cylinder; an ignition system including at least a spark plug; a control system configured to vary a level of ignition energy provided to the cylinder via the spark plug in response to a composition of the fuel provided to the cylinder by the fuel system. As one example, the control system can respond to a fuel having mixtures of gasoline and alcohol (such as ethanol) in varying relative amounts. A method of operating the engine system by varying a level of ignition energy provided to the engine after a start-up is also provided, whereby the level of ignition energy can be adjusted in response to the temperature of the engine and/or the number of combustion events that have occurred since start-up. In some examples, the adjustment of ignition energy may be accompanied by an adjustment in the amount of fuel delivered to the engine for a given air charge.

In this way, combustion quality can be improved during lower engine temperature conditions regardless of the composition of fuel that is available to the engine. Additionally, by operating the ignition system to provide increased levels of ignition energy under select operating conditions, accelerated degradation of the ignition system that may result from the increased ignition energy may be reduced or minimized. Further, such an approach may also be extended to hot restarts under selected conditions.

DETAILED DESCRIPTION

Figure 1:
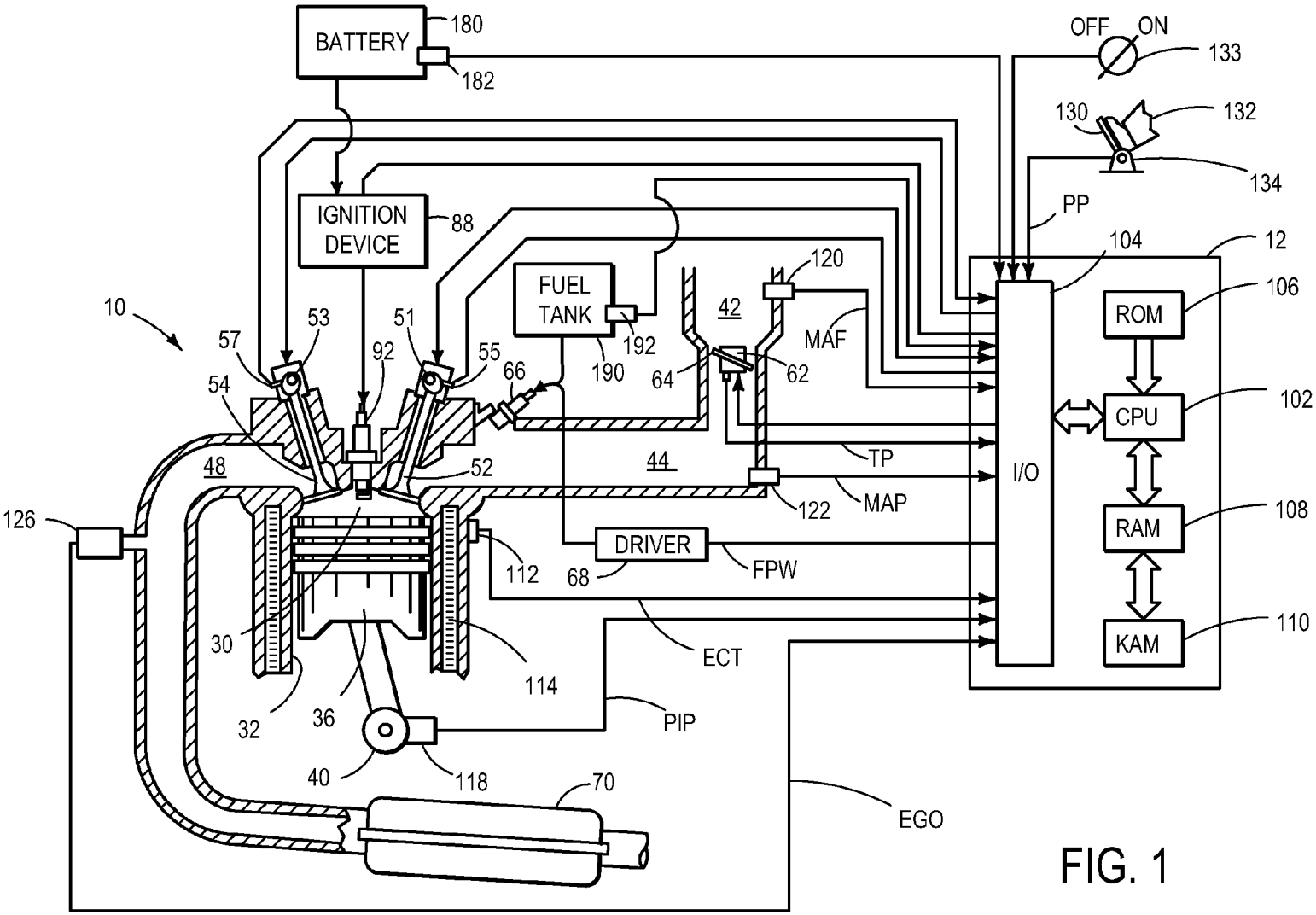
FIG. 1 shows a schematic depiction of an example engine system.

FIG. 1 shows a schematic depiction of an example combustion chamber or cylinder 30 of multi-cylinder engine system 10. As one example, engine system 10 can be configured in a vehicle propulsion system. Cylinder 30 can be defined by combustion chamber walls 32 with piston 36 moveably positioned therein. Piston 36 may be coupled to a crankshaft 40 that is operatively coupled to a drive wheel of the vehicle via a transmission. In some examples, a starter motor may be coupled to crankshaft 40 via a flywheel to enable a starting operation of engine system 10.

Cylinder 30 can receive intake air from intake manifold 44 via intake passage 42 and can exhaust combustion gases via exhaust passage 48. Intake manifold 44 and exhaust passage 48 can selectively communicate with cylinder 30 via respective intake valve 52 and exhaust valve 54. In some embodiments, cylinder 30 may include two or more intake valves and/or two or more exhaust valves.

The position of intake valve 52 may be controlled via an intake cam 51 and the position exhaust valve 54 may be controlled via an exhaust cam 53, in a configuration that may be referred to as dual overhead cam. Cams 51 and 53 can be coupled to respective camshafts that include a variable valve timing device that can be controlled by the engine control system. In other examples, valves 52 and 54 may be controlled by electromagnetic valve actuation (EVA) in response to the engine control system. Note that cylinder 30 can include two or more intake valve and/or two or more exhaust valves in some examples.

Fuel injector 66 is shown coupled along the intake passage upstream of cylinder 30 for injecting fuel in proportion to the pulse width of signal FPW received from controller 12 via electronic driver 68. In this way, fuel injector 66 provides what is known as port fuel injection (PFI). However, in other examples, fuel injector 66 may be coupled to cylinder wall 32 to enable direct injection of fuel into cylinder 30 in a configuration that may be referred to as direct injection (DI) of fuel.

Fuel can be provided to fuel injector 66 from a fuel storage device such as fuel tank 190 via one or more fuel pumps (not shown). A fuel sensor 192 may be provided with the fuel system to enable controller 12 to identify the composition of the fuel. As one non-limiting example, fuel sensor 192 can provide an indication of a concentration of an alcohol (e.g. ethanol or methanol) contained in the fuel. For example, controller 12 can identify a concentration of ethanol (e.g. % ethanol) of a mixed fuel including at least gasoline and ethanol. In this way, engine system 10 can be considered a flex fuel vehicle that can be operated with one or more different fuel compositions including E10 (e.g. approximately 10% ethanol and 90% gasoline) or E85 (e.g. approximately 85% ethanol and 15% gasoline), for example. However, it should be appreciated that various other fuel mixtures including up to 100% gasoline and up to 100% ethanol can be used, as well as other suitable mixtures of ethanol and gasoline.

Intake passage 42 can include a throttle 62 having a throttle plate 64. In this particular example, the position of throttle plate 64 may be varied by controller 12 via a signal provided to a throttle actuator included with throttle 62, a configuration that is commonly referred to as electronic throttle control (ETC). In this manner, throttle 62 may be operated to vary the intake air provided to cylinder 30 and other engine cylinders. An indication of the position of throttle plate 64 can be provided to controller 12 by throttle position signal TP. Intake manifold 42 can include a mass air flow sensor 120 and/or a manifold air pressure sensor 122 for providing respective signals MAF and MAP to controller 12.

Engine system 10 can include an ignition system that comprises an energy source such as battery 180 that provides electrical energy to ignition source 92 (which may be a spark plug) via an ignition device 88. Ignition device 88 may include one or more ignition coils, capacitors, electrical switches and distributors. Ignition device 88 can also receive input from crank angle sensor 118 for providing an ignition spark to each of the engine cylinders at their respective ignition timing. In some examples, battery 180 may include a battery sensor 182 that can provide an indication of battery state of charge (SOC) to controller 12. Controller 12 which is communicatively coupled with ignition device 88 can cause the ignition device to vary the relative timing at which the ignition spark is provided to the cylinder (e.g. via spark plug 92), the number of ignition spark events that are provided to the cylinder during a cycle, the frequency at which the ignition spark or spark events are provided to the cylinder, the magnitude of the electrical power provide by each ignition spark, and/or the duration or dwell of each spark event on a time or crank angle basis. Note that ignition device 88 can be considered part of the engine control system and may be combined with controller 12 in some examples.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 can include a three way catalyst (TWC), NOx trap, or other suitable emission control device. In some embodiments, during operation of engine 10, emission control device 70 may be periodically reset or purged by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Controller 12 can also receive input from a vehicle operator 132 via one or more user input devices. For example, an indication of the position of accelerator pedal 130 indicated as PP can be provided to controller 12 via pedal position sensor 134 for controlling the crankshaft output of engine system 10. Furthermore, an ignition switch 133 can provide an indication from the vehicle operator to controller 12 to start engine system 10.

As described above, FIG. 1 shows only one cylinder of a multi-cylinder engine system 10, and that each of the other cylinders may similarly include its own set of intake/exhaust valves, fuel injector, ignition source, etc. For example, ignition device 88 can provide ignition energy to ignition sources associated with the other engine cylinders. Similarly, fuel tank 190 can provide fuel to fuel injectors associated with other engine cylinders. Note that each cylinder can also include two ignition sources and/or two fuel injectors in some examples.

Figure 2:
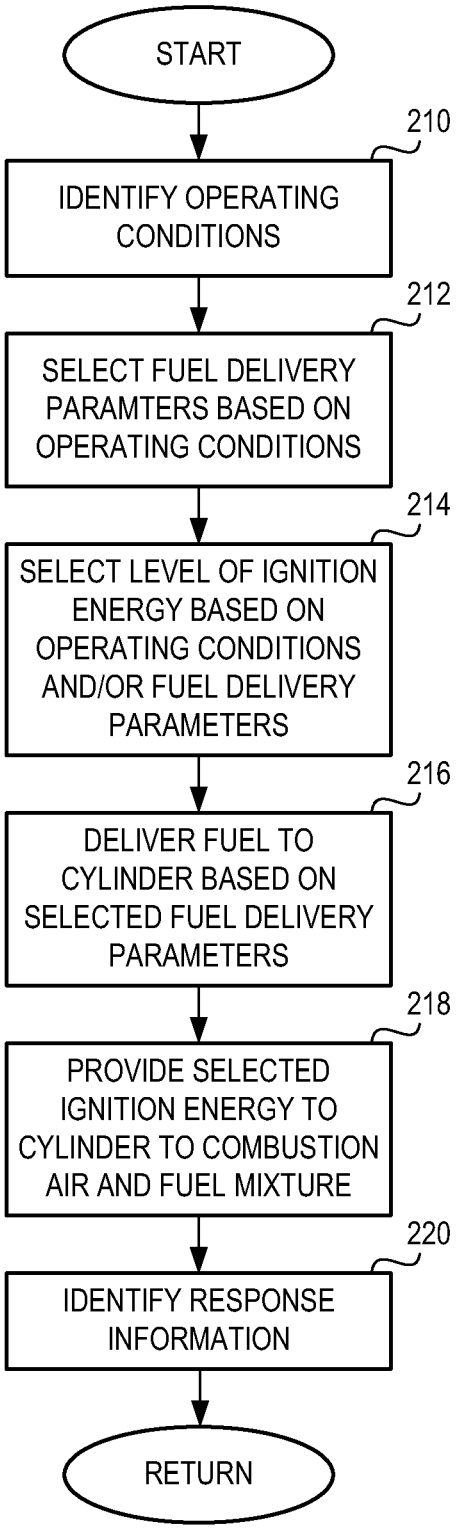
FIG. 2 shows a flowchart depicting an example approach for operating the engine system.

FIG. 2 shows a flow chart depicting an approach for selecting the level of ignition energy to be provided to cylinders of the engine based on operating conditions. Referring specifically to operations indicated at 210-220, operating conditions identified at 210 can be used to select an appropriate level of ignition energy at 214 to be provided to each cylinder of the engine at 218. The operating conditions identified at 210 may include one or more of the following: engine crank angle, engine speed, engine temperature including coolant temperature (e.g. via sensor 112), exhaust gas temperature, intake manifold temperature, cylinder temperature, fuel composition (e.g. such as concentration of ethanol in the fuel), fuel temperature, the quantity of fuel contained in the fuel tank, battery state of charge, a cylinder event number (e.g., combustion event number) from a first cylinder event (e.g. combustion), valve timing, and air/fuel ratio of the exhaust gas. Additionally, the control system can obtain operating condition information associated with commands that were issued or are to be issued to the engine by the control system. For example, the control system can identify the commands issued by controller 12 that are stored in memory. Further still, these operating conditions can be identified by the control system via the various sensors previously described with reference to FIG. 1.

At 212, the fuel delivery parameters including the amount of fuel to be delivered to each cylinder of the engine can be selected based on the operating conditions identified at 210. For example, the control system can adjust the amount of fuel delivered to each cylinder of the engine in response to feedback received from an exhaust gas sensor (e.g. sensor 126) to achieve a prescribed air/fuel ratio. As one particular example, during warm-up of the engine, such as after a cold start, the air/fuel ratio provided to the engine may be controlled to a richer setting under lower temperatures, whereby the amount of fuel is increased relative to the amount of air. For example, the amount of fuel relative to the amount of air can be increased to increase the reliability of combustion. Furthermore, in some examples, this increase in fuel quantity relative to air can be selected based on the concentration of ethanol or other alcohol in the fuel. For example, fuel having a higher concentration of ethanol can have a higher heat of vaporization, which can reduce the ignitability of the fuel. Thus, with higher concentrations of ethanol, the mass of fuel may be increased during warm-up to increase combustion stability. Thus, the air/fuel ratio can be prescribed by the control system in response to an indication of ethanol concentration in the fuel in order to deliver the appropriate caloric value of fuel to the engine across a variety of different ethanol concentration conditions.

Figure 5:
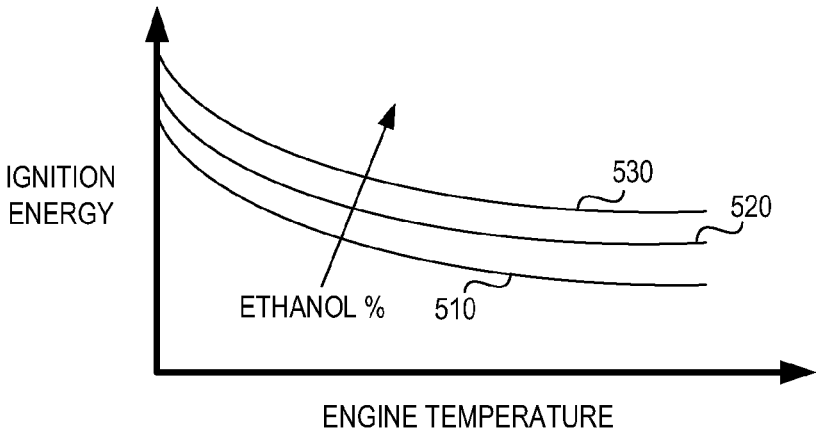
FIG. 5 shows a graph depicting how ignition energy provided to a cylinder of the engine can be varied in response to engine temperature and ethanol concentration in the fuel.

The level of ignition energy to be provided to each cylinder of the engine as selected at 214 can be based on one or more of the operating conditions identified at 210 and/or the fuel delivery parameters selected at 212. For example, the control system can select a level of ignition energy to be provided by an ignition source of each cylinder on a per cycle, or per combustion event, basis based on a look-up table or map stored in memory. Referring also to FIG. 5, a graph is shown depicting an example ignition control map that can be used to select the appropriate ignition energy to be provided to the engine based on operating conditions including engine temperature and concentration of ethanol in the fuel. In particular, FIG. 5 shows a family of curves representative of different ethanol concentrations as indicated at 510, 520, and 530. As one non-limiting example, curve 510 represents a first concentration of ethanol that is less than the concentrations indicated at 520 and 530 and curve 530 represents a second concentration of ethanol that is greater than the concentrations indicated at 510 and 520. As described with reference to FIG. 1, the concentration of ethanol can be obtained from a fuel composition sensor such as sensor 192. Alternatively, an indication of the concentration of ethanol or other alcohol in the fuel can be obtained from feedback provided by exhaust gas sensor 126 in response to a known fuel injection quantity (e.g. as selected at 212) and the air charge. Furthermore, the composition of the fuel, including ethanol concentration, can be obtained or learned by the control system from a pervious engine operation where it may be used during a subsequent start-up of the engine to adjust ignition energy.

As shown by the graph of FIG. 5, as the temperature of the engine increases, such as during warm-up of the engine from a cold start condition, the ignition energy can be reduced or remain constant for a given ethanol concentration of the fuel. For example, where the ethanol concentration indicated at 510 is less than a threshold, the ignition energy may not be increased during the lower engine temperature conditions. However, where the ethanol concentration is greater than a threshold, such as with the concentrations indicated at 520 and 530, the ignition energy may be increased during cooler engine temperature conditions and reduced during warmer engine temperature conditions. In this way, the control system can select an appropriate level of ignition energy to be delivered to each cylinder of the engine based on the operating conditions identified at 210. Note that in some conditions, such when the fuel includes a lower concentration of ethanol, the ignition energy provided to the engine can be controlled to a constant level across all temperature conditions.

At 216, the amount of fuel prescribed by the fuel delivery parameters selected at 212 can be delivered to the engine by way of direct and/or port injection of the fuel to the various cylinders in coordination with the cylinder firing order and valve timing of the respective cylinders. For example, referring to cylinder 30 of FIG. 1, the control system can activate driver 68 to cause fuel injector 66 to deliver the prescribed amount of fuel to cylinder 30. It should be appreciated that in some examples, each cylinder can receive fuel from two separate injectors, whereby the control system can control each of the injectors to provide the total prescribed amount of fuel to the cylinder. With port fuel injectors, the control system can adjust the port injectors to provide one or both of open intake valve injection or closed intake valve injection, and vary which of the open or closed intake valve injection type are used based on ignition energy level and/or ethanol concentration.

At 218, the selected ignition energy can be provided to each of the engine cylinders via their respective ignition sources to ignite and combust the air and fuel mixture contained therein. For example, the control system can control ignition system 88 to provide the ignition energy selected a 214 to each of the cylinders at the prescribed firing order and ignition timing. Note that each cylinder can receive a different level of ignition energy, for example, where the operating conditions of the engine are transient, such as during a warm-up phase of the engine. The level of ignition energy provided to the cylinders can be reduced over a plurality of cycles as shown in FIGS. 6A-6J and FIGS. 7A and 7B, for example.

As will be described in greater detail with reference to FIG. 3, the ignition energy selected for a particular cylinder at 214 can be provided to that cylinder by utilizing one, two, or more discrete ignition spark events during a cycle of the cylinder, by controlling the duration or dwell of each ignition spark event performed during the cycle, and/or by controlling the magnitude of the electrical power provided by each ignition spark event performed during the cycle. Thus, the control system can increase or decrease the ignition energy provided to a particular cylinder of the engine by increasing or decreasing the number of spark events, the duration of each spark event, and/or the magnitude of the electrical power provided by the spark events.

The routine can then advance to 220 where the engine response to the preceding actions carried out at 210-218 can be assessed. As one non-limiting example, the control system can learn errors in the fuel injection amount and level of ignition energy selected at 212 and 214 based on feedback from the various engine sensors. For example, the control system can correct the fuel injection or ignition energy based on feedback from the exhaust gas sensor and/or an indication of poor combustion quality. As will be described with reference to FIG. 3, where the exhaust gas sensor indicates a higher amount of unburned hydrocarbons relative to the air charge, the control system may increase the ignition energy to cause more complete combustion of the air and fuel mixture during subsequent cylinder firing events. Finally, the routine can return to 210 for subsequent engine cycles.

Figure 3:
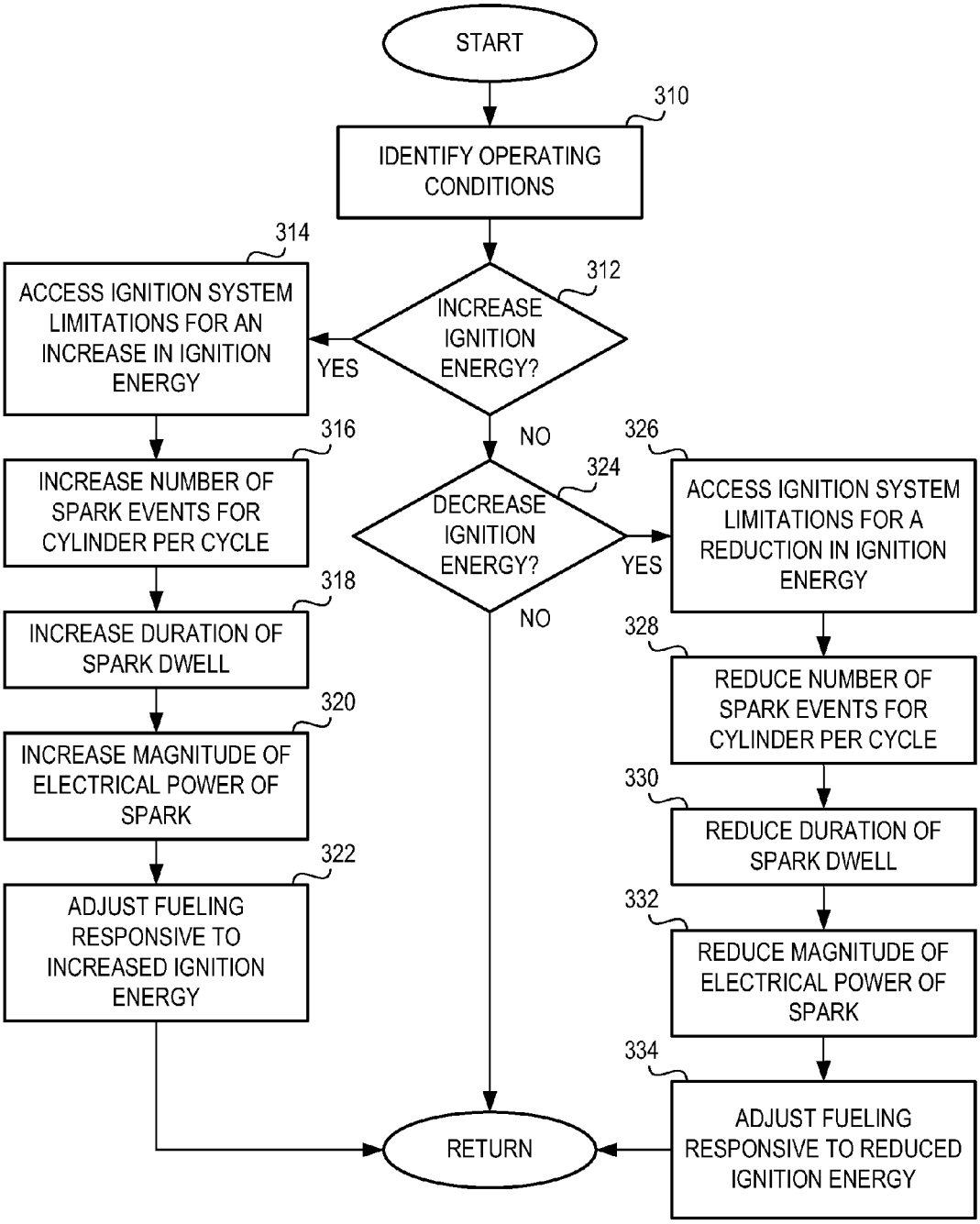
FIG. 3 shows a flowchart depicting an example approach for adjusting a level of ignition energy provided to an example cylinder of the engine system during a cycle.

FIG. 3 shows a flowchart depicting a method for adjusting an amount of ignition energy that is delivered to a cylinder of the engine during a cycle. At 310, the operating conditions of the engine system can be identified. Note that these operating conditions can include those previously described at 210 as well as the fuel delivery parameters selected at 212. At 312, if the ignition energy is to be increased, the routine can proceed to 314. Alternatively, if at 312 the ignition energy is not to be increased, the routine can proceed to 324. As one example, the control system can judge whether to increase the ignition energy responsive to operating conditions identified at 310 or engine performance responses learned from 220.

Figure 7A:
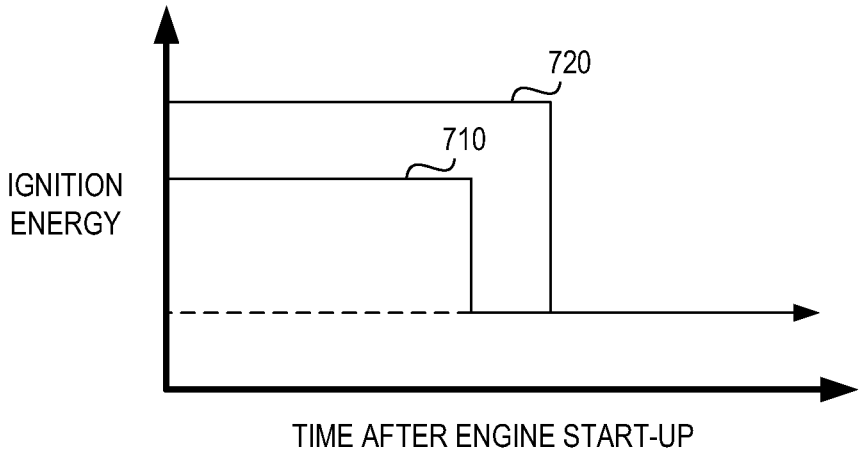
FIGS. 7A and 7B show example timelines depicting how ignition energy levels can be varied after start-up of the engine system.
Figure 7B:
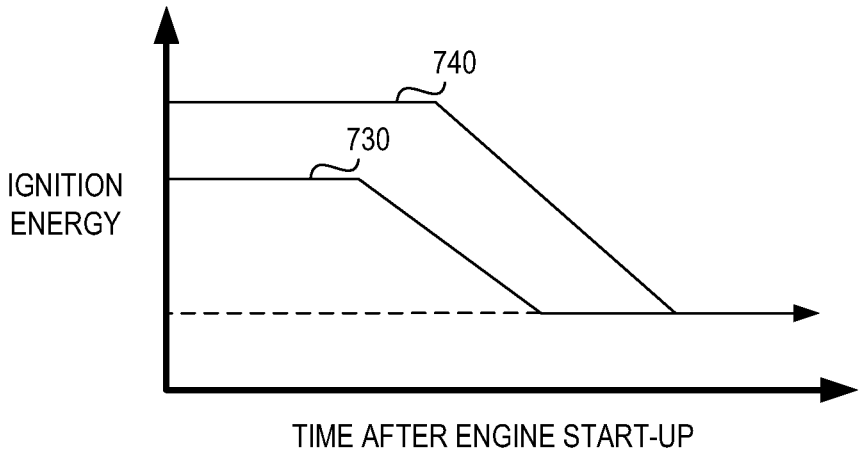

As one particular example, the control system can increase the ignition energy during cooler engine condition and can reduce the ignition energy during warmer engine conditions. As another example, the control system can increase the ignition energy when a fuel including a higher concentration of ethanol or other alcohol is used by the engine and can reduce the ignition energy when the fuel includes a lower concentration of ethanol or other alcohol. As yet another example, the control system can increase the ignition after start-up for a first period of time and then can subsequently reduce the ignition energy as shown in FIGS. 7A and 7B.

At 316, 318, and 320 one or more ignition parameters may be adjusted to increase the ignition energy provided to the cylinder during a cycle of the cylinder. However, before an adjustment of the ignition parameters is performed, the ignition system limitations may be assessed at 314. For example, at 314 the control system can identify prescribed hardware limitations stored in memory to determine which of the ignition parameters can be adjusted and the extent to which they can be adjusted in order to increase ignition energy. As one example, the engine ignition sources can impose limitations on the minimum ignition power that can be provided on a single spark event. As another example, the maximum amount of power that can be delivered by the ignition system during a single event may be limited by the ignition device or the battery. As still another example, the ignition system may be limited by a minimum period of time between consecutive ignition events. Thus, by identifying the various limitations of the ignition system, the ignition energy that is delivered to each combustion chamber of the engine can be controlled to a prescribed value. Note that in some examples, like other features described herein, the operation at 314 may be omitted, such as where the control system utilizes a predefined approach for increasing ignition energy that is already accounts for the various ignition system limitations.

At 316, the number of ignition events that are performed in each cylinder per cycle may be increased to increase ignition energy delivered to the cylinder. For example, the controller can command the ignition device to deliver two or more spark events consecutively via the cylinder's ignition source. If the cylinder includes two ignition sources, the control system can cause the ignition sources to fire simultaneously or in succession. In this way, the control system can increase the number of spark events provided to the cylinder in order to increase ignition energy, which can be used to promote more complete combustion of the air and fuel mixture contained therein.

At 318, the duration or some or all of the ignition events may be increased to increase ignition energy delivered to each cylinder of the engine. For example, the controller can command the ignition device to increase the ignition spark dwell time for some or all of the cylinders. An increase of the spark dwell may also include an increase in the overall electrical energy retained by the ignition device prior to initiating the spark. Furthermore, it should be appreciated that when the ignition device is delivering multiple spark events to a cylinder during a cycle, the ignition device may be commanded to reduce the dwell of some or all of the spark events performed by the ignition source.

At 320, the power of each spark may be increased to increase the ignition energy that is provided to each cylinder of the engine. For example, the controller can command the ignition device to increase the magnitude of the electrical power that is provided to the combustion chamber via one or more spark events. Note that the ignition system can increase the magnitude of the electrical power for some or all of the spark events performed within a cylinder per cycle.

Each of the ignition parameters described at 316, 318, and 320 can be adjusted together or individually by the control system in order to increase ignition energy delivered to the cylinders. Note that in some examples, some of these ignition parameters can be reduced while other ignition parameters are increased in order to increase the total ignition energy delivered to each cylinder during a cycle. For example, in order to avoid ignition system limitations, the control system may increase ignition energy by increasing the number of spark events while decreasing the duration and/or power supplied to the combustion chamber during each of the events. As another example, the control system may increase ignition energy by increasing spark dwell while reducing the magnitude of the electrical power delivered over the duration of the spark. FIGS. 6H-6J show some examples of this approach.

At 322, the control system may adjust the amount of fuel delivered to the combustion chamber relative to the amount of air charge in response to the increase in ignition energy. For example, the amount of fuel delivered to the combustion chamber may be reduced or increased relative to the amount of air contained in the air charge with increasing ignition energy. In this way, by increasing or reducing the amount of fuel delivered to the combustion in response to the ignition energy, the combustion quality can be increased while also ensuring stable combustion.

Referring now to 324, if the ignition energy is to be decreased, the routine can proceed to 326. Else, the routine can return. At 326, the ignition system limitations can be assessed in terms of reducing the ignition energy delivered to some or all of the engine cylinders. Note that the operation at 326 can be similar to the operation described at 314, whereby the control system can assess the various limitations of the ignition system in terms of the various ignition parameters that are to be adjusted. Also, it should be appreciated that the operation at 326 can be omitted in some examples.

At 328, the number of spark events performed at each cylinder per cycle can be reduced to reduce ignition energy. At 330, the duration or dwell of some or all of the spark events can be reduced to reduce ignition energy. At 332, the magnitude of the electrical power delivered by some or all of the spark events can be reduced to reduce ignition energy. However, as described with reference to operations 316, 318, and 320 for increasing ignition energy, in some examples, one or more of the ignition parameters may be adjusted in the opposite direction in order to avoid ignition system limitations. For example, the number of spark events may be reduced while the dwell and/or power of each spark may be increased to reduce the overall level of ignition energy provided to the cylinder per cycle. As another example, the magnitude of the electrical power provided by each spark may be reduced while the dwell of each spark is increased in order to reduce the overall level of ignition energy provided to the cylinder per cycle. Thus, the control system can be configured to adjust the ignition system parameters to increase or decrease the overall ignition energy provided to cylinders during each cycle.

At 334, the amount of fuel delivered to each cylinder may be increased or reduced relative to the air charge when the ignition energy was reduced. In this way, the air/fuel ratio delivered to the cylinders can be adjusted in response to the ignition energy to improve combustion quality, thereby reducing the amount of unburned fuel exhausted by the engine.

Figure 4:
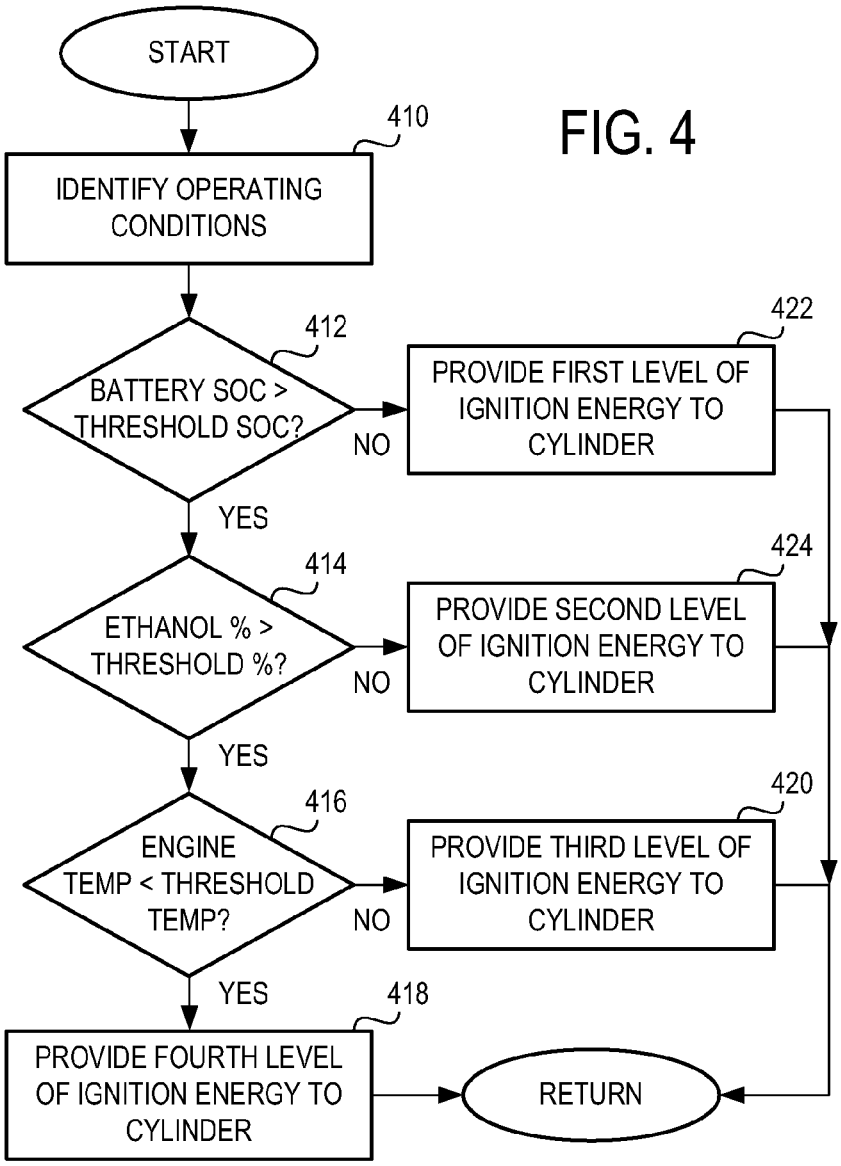
FIG. 4 shows a flowchart depicting an example approach for selecting a level of ignition energy to be provided to an example cylinder of the engine system during a cycle.

FIG. 4 shows a routine depicting another approach for controlling the level of ignition energy delivered to a cylinder of the engine. Beginning at 410, the operating conditions of the engine can be identified, for example, as previously described at 210 and 310. For example, the control system can identify the conditions of the fuel (e.g. ethanol concentration), the amount of fuel delivered to the combustion chamber during the cycle, battery SOC and the temperature of the engine and/or ambient, among others.

At 412, if the battery SOC is above a threshold SOC, the routine can proceed to 414. Alternatively, the routine can proceed to 412. As one non-limiting example, the control system can assess the battery SOC at key-on or engine start-up via sensor 182. If the battery SOC is lower than the threshold, the control system can command a first level of ignition energy to be provided to some or all of the cylinders on a per cycle basis as indicated at 422. In some examples, the control system can be configured to select an ignition energy based on the battery SOC that will ensure a successful start-up of the engine. In this way, by limiting the increase of ignition energy, the engine can still be started even when the battery SOC is low.

At 414, if the ethanol concentration in the fuel is not greater than a threshold concentration, a second level of ignition energy may be provided to some or all of the cylinders of the engine as indicated at 424. For example, the control system can identify the concentration of ethanol contained in the fuel via sensor 192. In this way, the control system can reduce ignition energy when the fuel does not contain higher concentrations of ethanol, thereby increasing efficiency of the engine system and increasing the life cycle of the ignition system. Note that the ignition energy levels provided at 422 and 424 can be the same or different. For example, the ignition energy provided at 422 can be greater than or less than the ignition energy provided at 424.

Alternatively, if the ethanol concentration in the fuel is greater than the threshold concentration, the routine can proceed to 416. If at 416, the engine temperature is less than a threshold temperature, the routine can proceed to 418. Alternatively, if the engine temperature is not less than the threshold temperature, the routine can proceed to 420. For example, the control system can identify engine temperature from sensor 112. As another example, the control system can use other indications of temperature such as ambient temperature, fuel temperature, intake air temperature, etc. At 420, a third level of ignition energy can be provided to some or all of the engine cylinders and at 418 a fourth level of ignition energy can be provided to some or all of the cylinders via their respective ignition sources. Thus, in this particular example, the ignition energy provided at 418 can be greater than the ignition energy provided at 420. However, the ignition energy provided at 420 can be the same as or different than the ignition energy provided at 422 and 424. For example, the ignition energy provided at 420 can be greater than the ignition energy provided at 424 and the ignition energy provided at 424 can be greater than the ignition energy provided at 422. In this way, the control system can respond to various operating conditions by adjusting the ignition energy provided to some or all of the engine cylinders.

Referring now to FIGS. 6A-6J, examples are provided showing how ignition energy may be reduced over a plurality of cycles for an example cylinder of an engine. For example, upon start-up of the engine, the engine cylinders can be provided an increased level of ignition energy for one or more cycles and thereafter they can be provided with a reduced level of ignition energy as shown in FIG. 7. Note that the operations described with reference to FIGS. 6A-6J can also be performed in reverse in order to increase ignition energy.

In each of the examples shown in FIGS. 6A-6J, the horizontal axis provided an indication of time and includes a further indication of the piston position. In each of these examples, the engine is configured to operate in a four stroke cycle, whereby ignition of an air and fuel mixture is performed every four strokes for a given cylinder. The vertical axis provides an indication of ignition energy as is depicting in a decreasing state with time as indicated at 610. Note that while each of FIGS. 6A-6J show multiple different levels of ignition energy, in other examples, the ignition energy can be adjusted between only two different levels or the ignition energy can be adjusted through a range of different ignition levels.

Figure 6A:
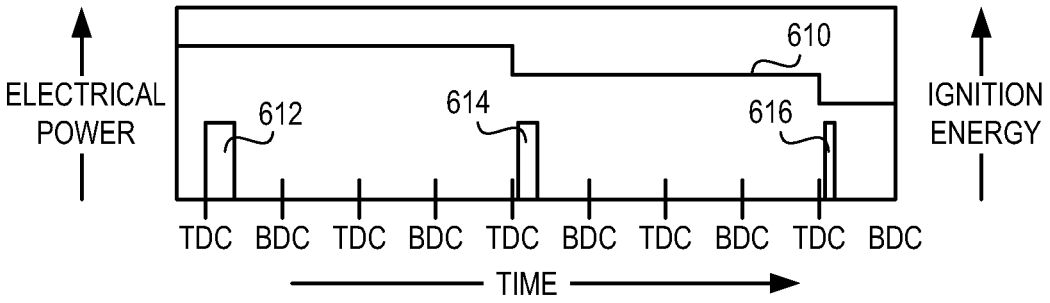
FIGS. 6A-6J show example timelines depicting various approaches for increasing ignition energy provided to a cylinder of the engine system.

Referring specifically to FIG. 6A, a first ignition event is performed as indicated at 612, followed by a second ignition event indicated at 614, and a third ignition event indicated at 616. Each of ignition events 612, 614, and 616 can be performed around top dead center (TDC) of the power stroke. As can be observed from a comparison of the ignition events, ignition event 612 has a longer spark dwell than ignition events 614 and 616 having similar spark magnitudes, thereby resulting in a higher level of ignition energy during the particular cycle. Similarly, ignition event 614 has a longer spark dwell than ignition event 616, thereby resulting in a higher level of ignition energy. Note that the initiation timing of the spark can be held constant across different ignition energy levels or the spark timing can be advanced or retarded with increasing or decreasing ignition energy. Further still, in some examples, the timing at which the spark is initiated during each cycle can be adjusted so that the average ignition energy is delivered at a constant spark timing.

Figure 6B:
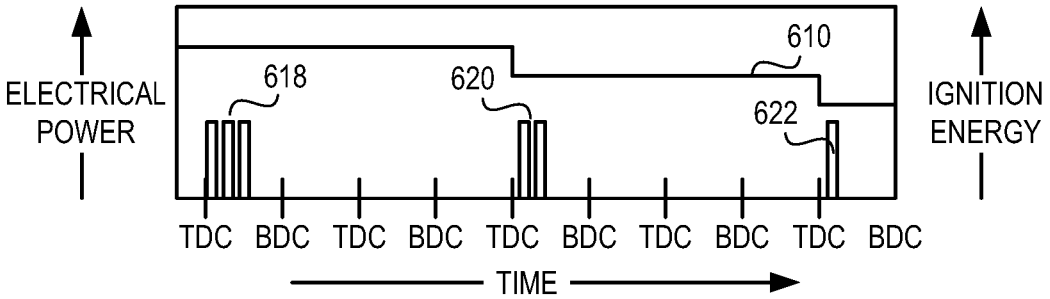

FIG. 6B shows how the ignition energy can be reduced by reducing the number of separate spark events that are performed during each ignition event. For example, ignition event 618 includes three spark events and ignition event 620 includes two spark events of similar magnitude (e.g. electrical power) and dwell. Ignition event 622 includes one spark event of similar magnitude and dwell. Thus, ignition event 618 provides greater ignition energy to the cylinder than ignition event 620, which in turn provides greater ignition energy to the cylinder than ignition event 622.

Figure 6C:
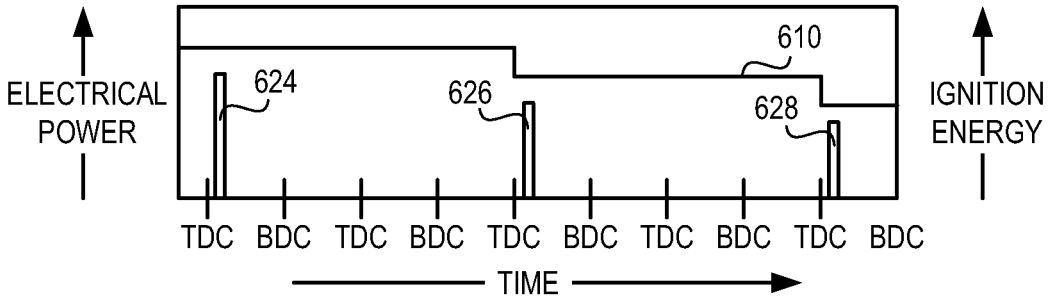

FIG. 6C shows how the ignition energy can be reduced by reducing the magnitude of the electrical power that is provided to the cylinder during each spark event. For example, ignition event 624 has a greater magnitude than ignition event 626 and includes a similar spark dwell. Similarly, ignition event 626 has a greater magnitude than ignition event 628 and also includes a similar dwell. Thus, ignition event 624 provides greater ignition energy to the cylinder than ignition event 626, which in turn provides greater ignition energy to the cylinder than ignition event 628.

Figure 6D:
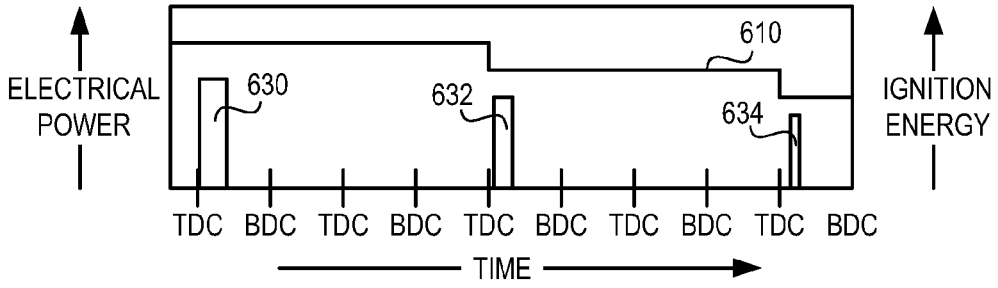

FIGS. 6D-6G show how the approaches shown in FIGS. 6A-6C can be used in combination to adjust the level of ignition energy over a plurality of ignition events. For example, FIG. 6D shows how ignition energy can be reduced over a plurality of ignition events indicated at 630, 632, and 634 by reducing both the dwell and the magnitude of the spark used in each ignition event relative to a previous ignition event.

Figure 6E:
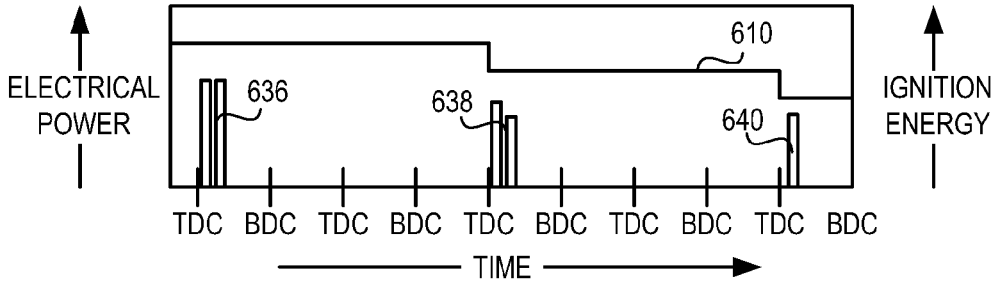

FIG. 6E shows how ignition energy can be reduced over a plurality of ignition events indicated at 636, 638, and 640 by reducing the number of separate spark events performed per cycle and/or the magnitude of each spark event relative to a previous ignition event. Furthermore, it can be shown how the magnitude of the electrical power used by two or more spark events during a single ignition event can be different as shown at 638 or the same as shown at 636.

Figure 6F:
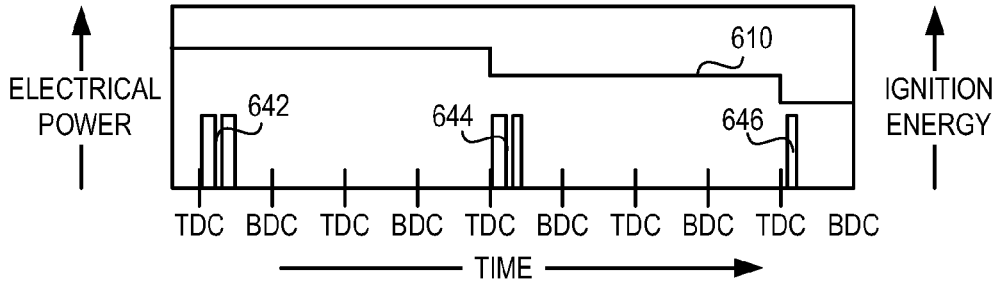

FIG. 6F shows how ignition energy can be reduced over a plurality of ignition events indicated at 642, 644, and 646 by reducing the number of separate spark events performed per cycle and/or the dwell of each spark event relative to a previous ignition event. Furthermore, it can be shown how the magnitude of the dwell of two or more spark events during a single ignition event can be different as shown at 644 or the same as shown at 642.

Figure 6G:
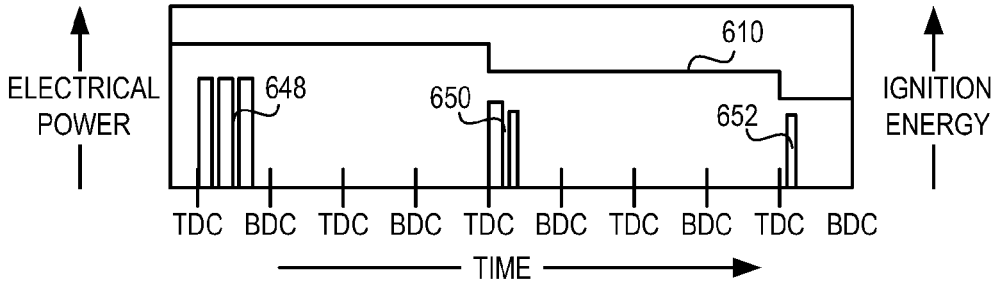
Figure 6H:
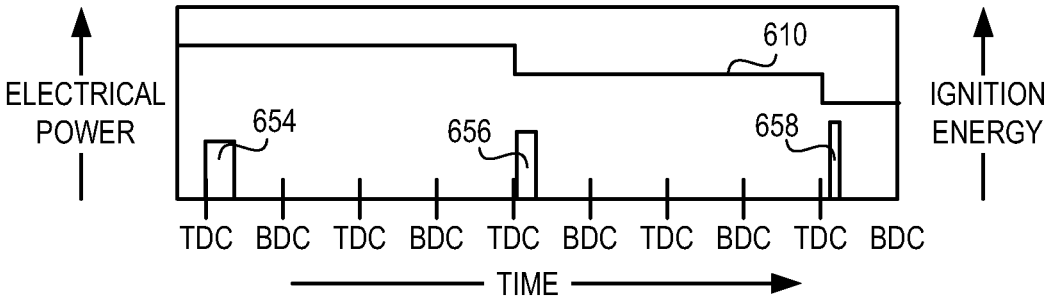
Figure 6I:
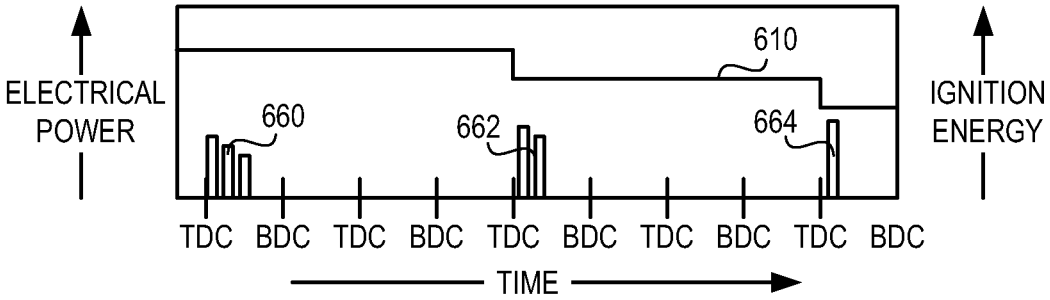
Figure 6J:
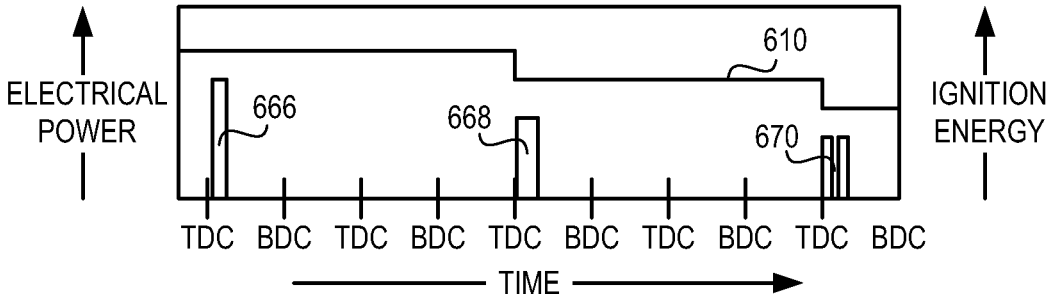

FIG. 6G shows how ignition energy can be reduced over a plurality of ignition events indicated at 648, 650, and 652 by reducing the number of separate spark events performed per cycle, the dwell of some or all of the spark events, and/or the magnitude of some or all of the spark events.

FIGS. 6H-6J show how ignition energy can be reduced over a plurality of ignition events even while a particular ignition parameter is adjusted in a direction that would otherwise increase ignition energy. The example approaches shown in FIGS. 6H-6J can be used to avoid limitations imposed by some of the ignition parameters as described with reference to 314 and 326 of FIG. 3. For example, as shown in FIG. 6H with reference to ignition events 654, 656, and 658, the total ignition energy provided to the cylinder during each cycle can be reduced by sufficiently reducing spark dwell even as the magnitude of electrical power provided by each spark event is increased.

As shown in FIG. 6I with reference to ignition events 660, 662, and 664, the total ignition energy provided to the cylinder during each cycle can be reduced by reducing the number of spark events performed per cycle even as the magnitude of electrical power provided by each spark event is increased.

As shown in FIG. 6J with reference to ignition events 666, 668, and 670, the total ignition energy provided to the cylinder during each cycle can be reduced by reducing the magnitude of electrical power supplied by each spark even as the dwell and/or number of spark events per cycle is increased.

Thus, as can be demonstrated by the examples of FIGS. 6H-6J, the ignition parameters can be adjusted in variety of different directions while still reducing (or increasing) the total ignition energy delivered to a particular cylinder of the engine on a per cycle basis. Note that in each of the examples shown in FIGS. 6A-6J, the reduction (or increase) of ignition energy need not be performed over a single cycle, but can be achieved over a plurality of cycles. For example, as shown in FIG. 7, the ignition energy provided to each cylinder per cycle can be held substantially constant for a prescribed period of time (e.g. after engine start) before being adjusted to a subsequent level.

FIGS. 7A-7B show timelines depicting how an initially higher level of ignition energy can be provided to each cylinder of the engine after start-up followed by a lower level of ignition energy. In particular, FIG. 7A shows how the level of ignition energy can be adjusted between two different levels as indicated at 710. The operation shown at 710 can represent a fuel that includes a first concentration of ethanol while the operation shown at 720 can represent a fuel that includes a second concentration of ethanol greater than the first concentration. Thus, as can be observed from a comparison of 710 and 720, the difference between the higher and lower ignition levels and/or the duration of the higher ignition level can be adjusted in response to an operating condition such as ethanol concentration in the fuel. FIG. 7B by contrast shows how operations 730 and 740 for different ethanol concentrations, whereby the higher ignition energy level is gradually reduced to the lower ignition energy level. Thus, in this particular example, a plurality of different ignition levels can be used to gradually transition the engine from a cooler temperature condition to a warmer temperature condition. The examples shown in FIGS. 7A and 7B can be applied to an engine cold start. When the engine is restarted from a warmer condition, such as during a warm restart, the ignition energy may or may not be temporarily increased after start-up, but may instead be controlled to a lower level of ignition energy.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during an engine cold start, directly injecting a mixture of gasoline and alcohol to the engine;

decreasing an ignition energy level of a spark plug igniting the delivered mixture in the cylinder based on a number of combustion events that have occurred since the start.

2. The method of claim 1 wherein the alcohol includes ethanol.

3. The method of claim 1 wherein the level of ignition energy is further based on an engine temperature.

4. The method of claim 1, further comprising decreasing the level of ignition energy after the fuel has been provided to the cylinder.

5. The method of claim 2 wherein an ethanol concentration is learned from previous engine operation, and wherein a higher level of ignition energy is provided to the cylinder when the concentration of ethanol is higher and wherein a lower level of ignition energy is provided to the cylinder when the concentration of ethanol is lower.

6. The method of claim 3, wherein a higher level of ignition energy is provided to the cylinder when the temperature of the engine is lower and wherein a lower level of ignition energy is provided to the cylinder when the engine temperature is higher.

7. A method for an engine with a cylinder, comprising:

directly injecting, via a direct injector, a fuel including at least gasoline and ethanol to the cylinder during a cold engine start;

providing ignition energy to the cylinder via a spark plug to ignite the fuel;

reducing, during starting and after the fuel has been provided to the cylinder, a level of ignition energy of the spark plug in response to an engine temperature, a number of combustion events from the start, and an ethanol amount in the fuel; and increasing the level in response to an indication from an exhaust gas sensor of increased unburned hydrocarbons.

8. The method of claim 7 wherein the ethanol amount is an ethanol concentration of the fuel, wherein the ethanol concentration is learned from previous engine operation, and wherein a higher level of ignition energy is provided to the cylinder when the concentration of ethanol is higher and wherein a lower level of ignition energy is provided to the cylinder when the concentration of ethanol is lower.

9. The method of claim 8, wherein a higher level of ignition energy is provided to the cylinder when the temperature of the engine is lower and wherein a lower level of ignition energy is provided to the cylinder when the engine temperature is higher.

10. A method for an engine, comprising:

during an engine cold start, directly injecting, via a direct injector, a mixture of gasoline and alcohol to the engine; and then decreasing an ignition energy level of a spark plug igniting the delivered mixture in a cylinder based on a number of combustion events that have occurred since the start and an alcohol amount of the mixture; and increasing the level responsive to increased exhaust unburned hydrocarbons.

11. The method of claim 10 further comprising adjusting the ignition energy level based on an alcohol concentration of the mixture.

12. The method of claim 11 wherein the alcohol includes ethanol.

13. The method of claim 12, wherein the ignition energy level is increased with higher ethanol concentrations, and decreased with lower ethanol concentrations.

* * * * *